US012577798B2

(12) United States Patent
Herring et al.

(10) Patent No.: US 12,577,798 B2
(45) Date of Patent: Mar. 17, 2026

(54) CONTAINER ASSEMBLY AND METHOD FOR MAKING SAME

(71) Applicants: Jason Herring, Georgetown, TX (US); Shane Gilbreath, Georgetown, TX (US)

(72) Inventors: Jason Herring, Georgetown, TX (US); Shane Gilbreath, Georgetown, TX (US)

( * ) Notice: Subject to any disclaimer, the term of this patent is extended or adjusted under 35 U.S.C. 154(b) by 141 days.

(21) Appl. No.: 18/047,271

(22) Filed: Oct. 17, 2022

(65) Prior Publication Data

US 2023/0183994 A1 Jun. 15, 2023

Related U.S. Application Data

(63) Continuation-in-part of application No. 16/884,846, filed on May 27, 2020, now Pat. No. 11,473,323.

(51) Int. Cl.
*E04H 4/00* (2006.01)

(52) U.S. Cl.
CPC ..... *E04H 4/0043* (2013.01)

(58) Field of Classification Search
CPC ..... E04H 4/0043; E04H 4/005; E04H 4/0018
See application file for complete search history.

(56) References Cited

U.S. PATENT DOCUMENTS 3,416,165 A 12/1968 Pereira
3,501,782 A 3/1970 Schwarz et al.
3,736,599 A 6/1973 Kessler et al.
9,903,128 B2 2/2018 Lisk
D822,226 S 7/2018 Rathnam
D864,402 S * 10/2019 Rathnam ..... D24/204
D870,918 S * 12/2019 Rathnam ..... D25/2
D965,178 S * 9/2022 Rathnam ..... D8/359
11,473,323 B2 * 10/2022 Herring ..... F16B 17/008
2014/0298745 A1 * 10/2014 Rechenmacher ..... E04H 1/005 52/425
2018/0148945 A1 * 5/2018 Roux ..... E04H 4/0018
2021/0372151 A1 12/2021 Herring et al.
2023/0183994 A1 * 6/2023 Herring ..... E04H 4/005 4/513

OTHER PUBLICATIONS

U.S. Appl. No. 16/884,846, U.S. Pat No. 11,473,323, filed May 27, 2020, Container Assembly and Method for Making Same.
"U.S. Appl. No. 16/884,846, Restriction Requirement mailed Mar. 16, 2022", 5 pgs.
"U.S. Appl. No. 16/884,846, Response filed May 14, 2022 to Restriction Requirement mailed Mar. 16, 2022", 4 pgs.
"U.S. Appl. No. 16/884,846, Notice of Allowance mailed Jun. 8, 2022", 17 pgs.

* cited by examiner

*Primary Examiner* — Andrew J Triggs
(74) *Attorney, Agent, or Firm* — Schwegman Lundberg & Woessner, P.A.

(57) ABSTRACT

The invention is an assembly of prefabricated metal receptacles forming a swimming pool and a method for constructing the assembly. Among other features, the assembly is characterized by guided or unguided clamping structures that allow on-site construction without requiring on-site welding or access to the bottom or interior of the assembly.

11 Claims, 16 Drawing Sheets

CONTAINER ASSEMBLY AND METHOD FOR MAKING SAME

CROSS-REFERENCES TO RELATED PATENT APPLICATIONS

This application claims benefit of U.S. Non-Provisional patent application Ser. No. 16/884,846, filed on May 28, 2020, which is hereby specifically incorporated by reference in its entirety into the present disclosure.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND

The present invention relates to prefabricated swimming pools. More specifically this invention relates to swimming pools constructed of two of more prefabricated shell structures removably clamped together.

Swimming pools are a popular addition to residential and commercial housing projects. Both above ground and in-ground pools are popular. In addition, both modular pool assemblies, constructed from a number of interconnecting panels, and single-shell pool structures have been used in the prior art. Pools are constructed from metal, plastic, and fiberglass prefabricated components or custom engineered as on-site, concrete pools. Typically, pools are constructed with an outer structural form and lined with a watertight sealant or membrane. Despite decades of effort, most pools suffer from one or more of the following issues: high cost, complex construction, and poor design options. Embodiments of the present innovation address these issues in a novel way by exploiting features of intermodal metal shipping containers as prefabricated shell structures and providing an improved on-site assembly method.

The prior art discloses several examples of swimming pools and even modular housing structures constructed using intermodal shipping containers. However, typical shipping container pools have been limited to a single container or portions of a single container to provide a receptacle for water. This is due in part to previous construction techniques that require significant welding and do not provide a safe, on-site construction method for joining multiple containers.

At least one embodiment of the present claimed subject matter provides a useful, novel and non-obvious structure and method for joining multiple, modified containers providing multi-container pools and improved safety during construction.

SUMMARY

The illustrative embodiments provide computer implemented methods, apparatuses, and systems implementing computer usable program code for analyzing a plurality of devices and services across a computer enabled network such as the internet so that an accounting can be provided with the use of tokens.

Although, the present disclosure relates to different aspects and embodiments, it is understood that the different aspects and embodiments disclosed can be integrated, combined, or used together as a combination system, or in part, as separate components, devices, and systems, as appropriate. Moreover, paragraph headings are intended as organizational aids but not as limitations or constraints to the breadth of the disclosed innovation.

In part, this disclosure relates to a swimming pool structure and methods for assembling the structure. The pool structure consists of at least two intermodal metal shipping containers joined with no welding and no need for access along the interface seam between the two containers. The joined containers form a water reservoir. Furthermore, assembly of the structure can be done on-site and in-ground using a process that is reversible.

Modification of a Metal Intermodal Shipping Container

In one aspect, an intermodal shipping container (an example of a hollow rectangular prism) is modified to form an open receptacle and is used to provide a transportable, durable, and cost effective prefabricated shell for constructing a swimming pool. For example, unmodified, a container has six side panels, including a top panel, a bottom panel, a back panel, a front panel, and two end panels, where one end panel is a door or pair of doors. Modified containers are receptacles where several panels are completely or partially removed. For example, a rectangular receptacle for a swimming pool assembly as used in the present invention can be formed with two end panels, a back panel, and a bottom panel. The edge resulting from removing panels is called a free edge. At least two containers are suitably modified as open receptacles and joined to form a swimming pool assembly. By removing other combinations of panels or portions of panels, other swimming pool configurations can be formed.

Container to Container Interface

In one aspect, an assembly interface is formed by attaching a separate frame to the free edge of each receptacle. Among other benefits, each frame strengthens the free edge of each receptacle. The frame of at least one receptacle includes some threaded couplers. In addition, guide structures are attached or otherwise positioned along the bottom panel of at least one receptacle. The intention is to have at least one receptacle with captive internally threaded couplers positioned and aligned opposing a second receptacle with guide structures. In this case, the guide structures provide a convenient method to position threaded rods (long bolts) or to guide suitable bolt tightening tools. Access to the positioned threaded rods does not require access to the bottom panel of either receptacle. Access to the threaded rods is provided from a position adjacent to the receptacle.

Container Assembly and Principles of Construction

In one aspect, the present innovation provides for the safe and convenient assembly of at least two containers. Each container is modified as a framed receptacle and can be transported using any roadway suitable for a conventional intermodal container truck and trailer. On-site, the assembly of large metal structures often includes large, powerful equipment used to lift and position the structures. By separating a larger swimming pool into two movable receptacles, the loads are smaller and the required equipment can be smaller.

During installation, two receptacles are positioned adjacent to one another and clamped together using threaded rods and the captive couplers. Turning the threaded rods into the couplers pulls the receptacles together. In one embodiment, a seal structure is placed between the receptacles prior to clamping. The clamping can be done on-site and even with the receptacles positioned and safely resting inside an excavated hole. Thus, the seam between the two receptacles is joined and watertight without onsite welding.

The summarized assembly provides at least the following benefits:

- Reduced cost: Each receptacle can be transported separately eliminating more expensive transportation of large structures. In-ground installation can be done by lifting each receptacle separately and then clamping them together. This allows the use of smaller cranes and access to smaller installation sites.
- Improved safety: Injury danger is reduced because no human technician needs access to the bottom of the receptacles on-site.
- Design flexibility: Assembly using the guide structures provides a means to remove threaded rods (bolts) in the future and allows the structure to be disassembled, removed, and reassembled.
- No welding: No welding is done to join multiple receptacles on site.

Other benefits and advantages of the disclosed innovation will be apparent from careful study of the drawings and subsequent description.

DETAILED DESCRIPTION OF THE DRAWINGS

The figures are to be considered illustrative in all aspects and are not intended to limit the disclosure. The figures are not necessarily to scale. As shown in the Figures, FIG. 1 is an isometric view of a modified shipping container;

FIG. 2 is a view showing the reinforced free edge of a receptacle;

FIG. 3*a* is an exploded view of an embodiment of a modified and reinforced container showing guide tubes as guide structures;

FIG. 3*b* is an exploded view of an embodiment of a modified and reinforced container showing threaded couplers;

Figure 7A:
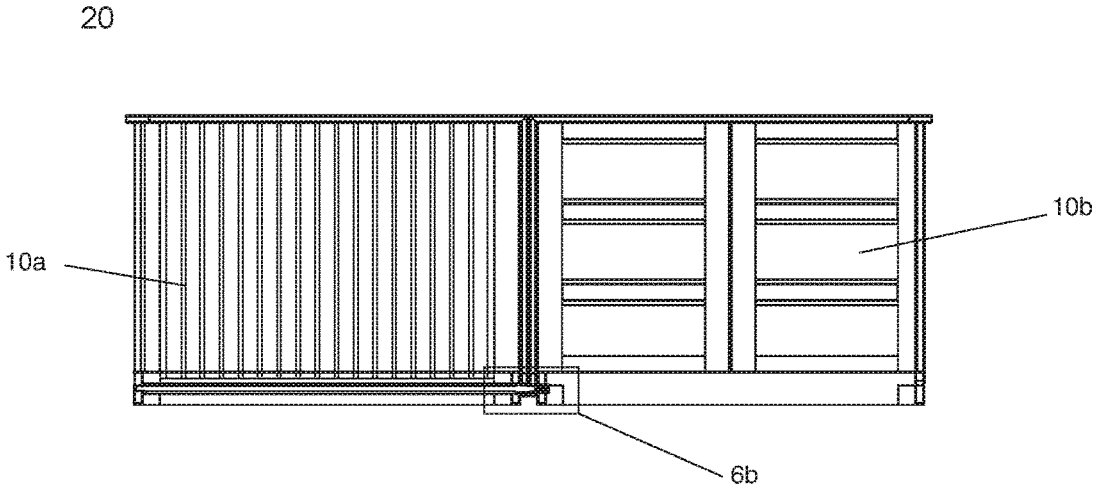
Figure 7B:
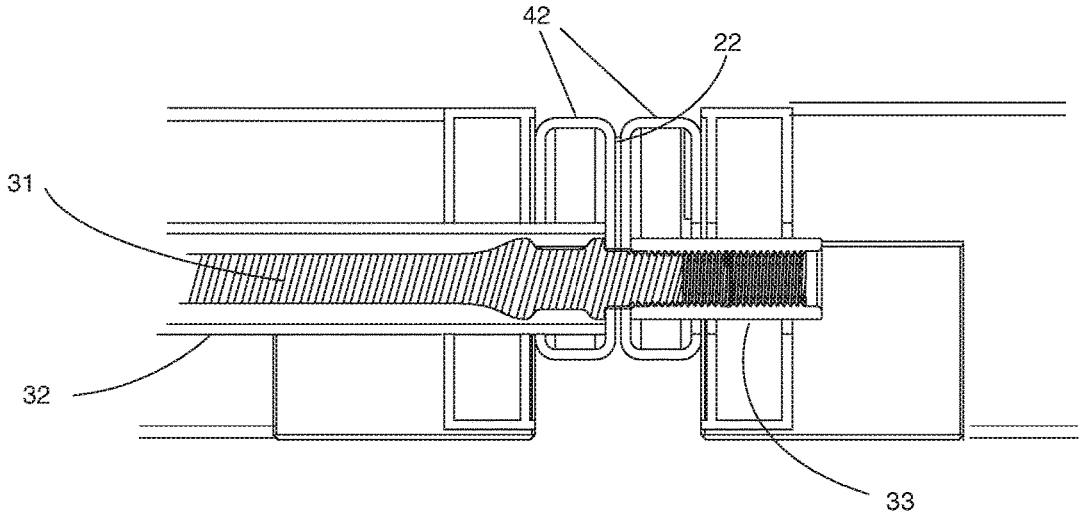
Figure 8:
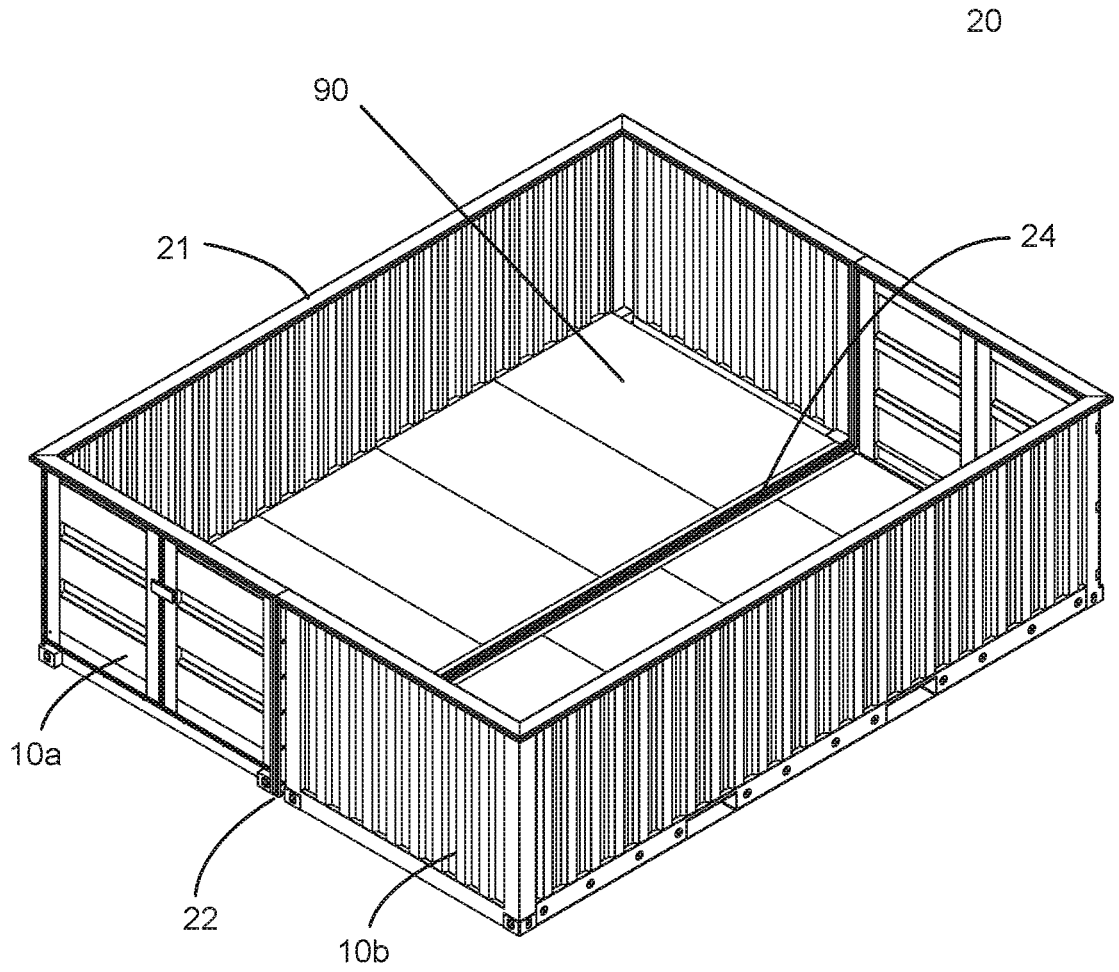
Figure 9A:
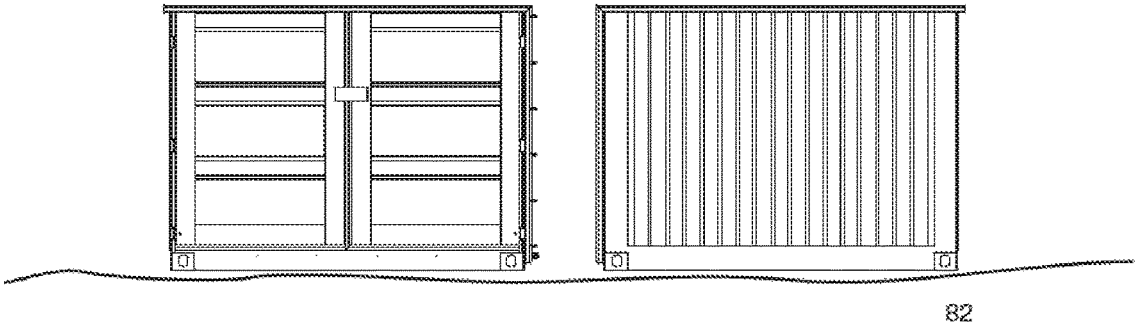
Figure 9B:
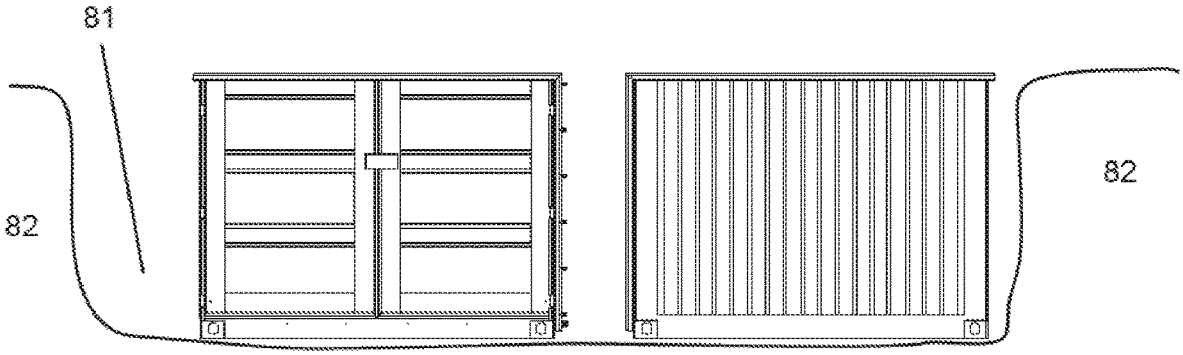
Figure 10:
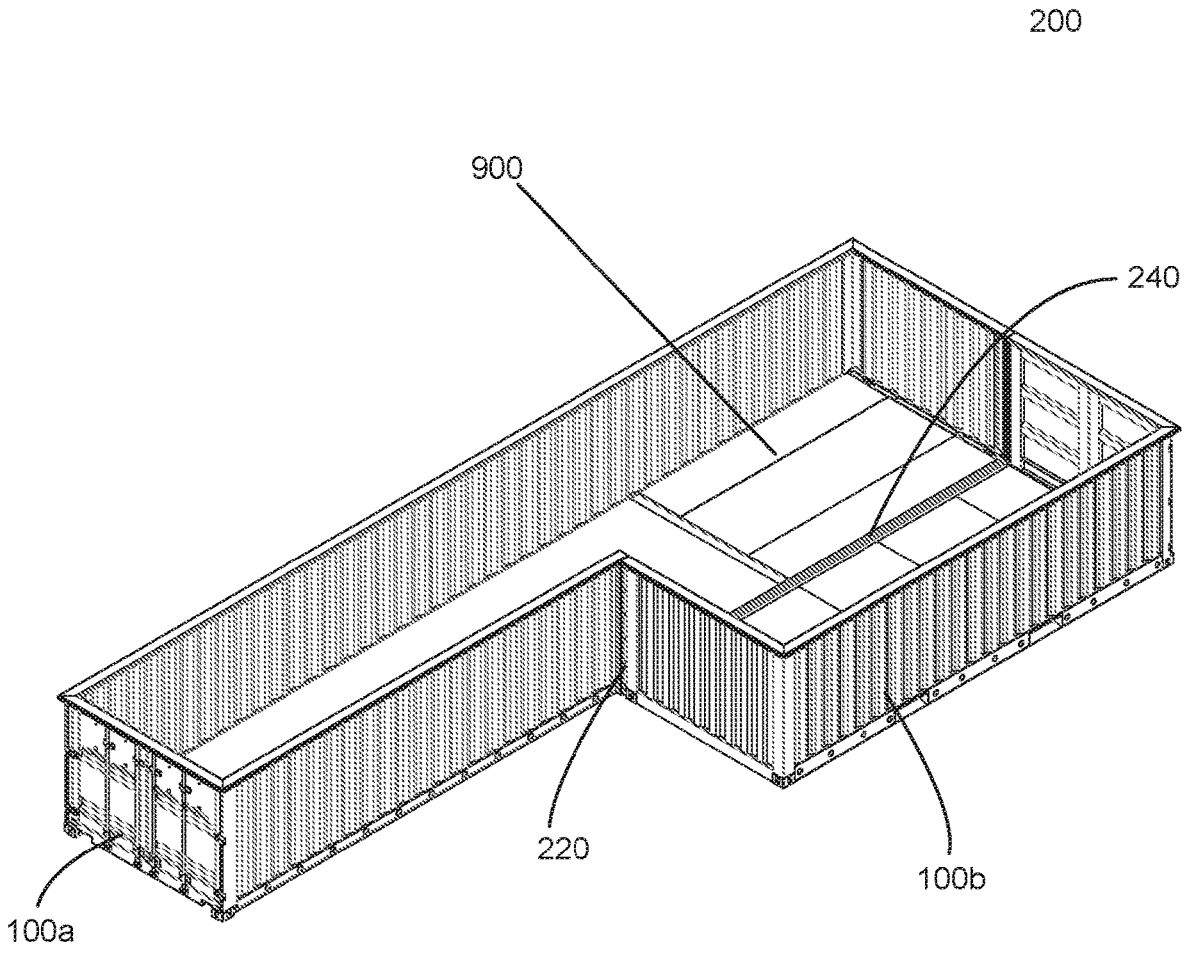
Figure 11:
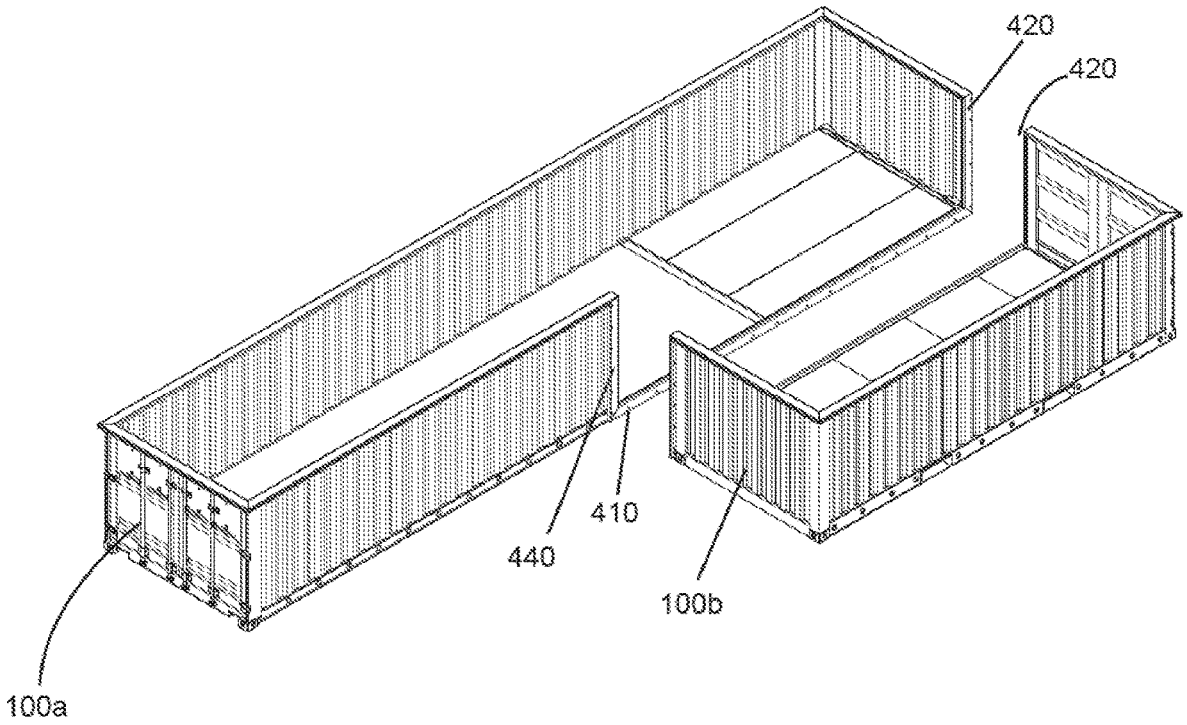
Figure 12:
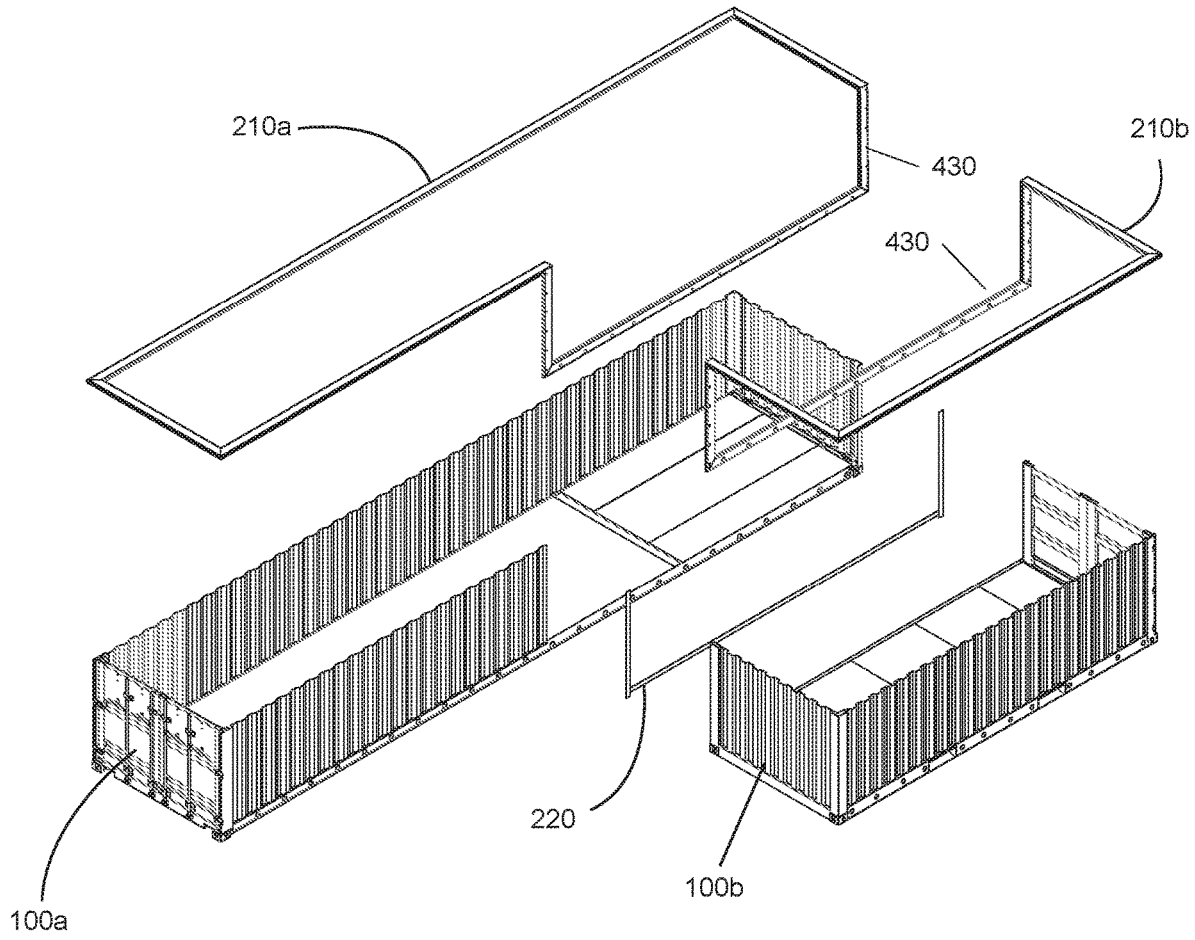
Figure 13A:
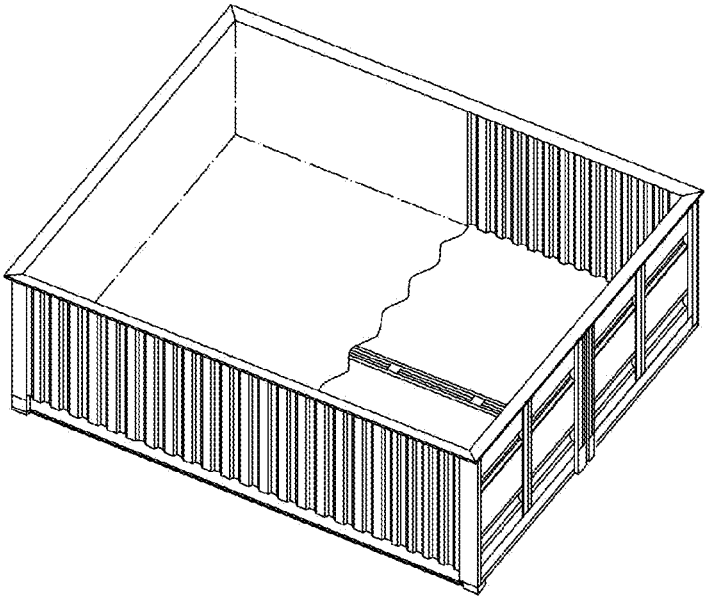
Figure 13B:
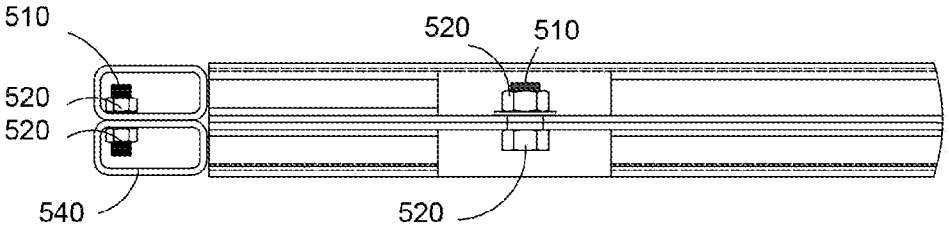
Figure 15A:
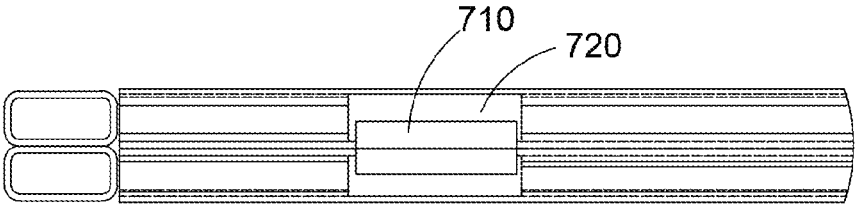
Figure 15B:
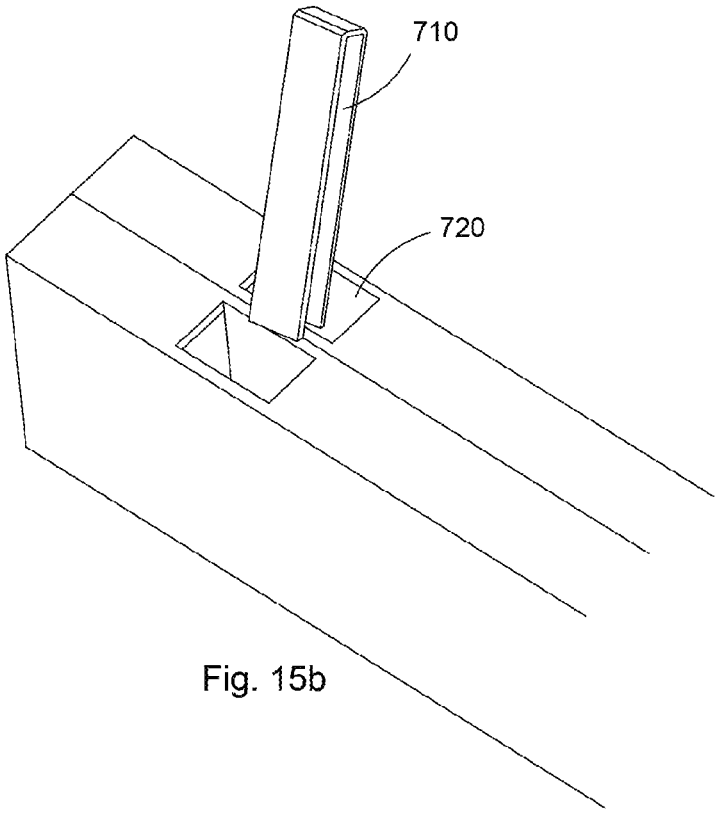
Figure 15C:
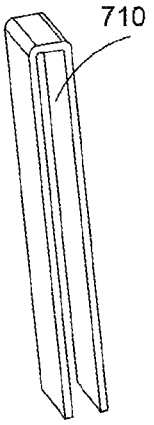
Figure 14A:
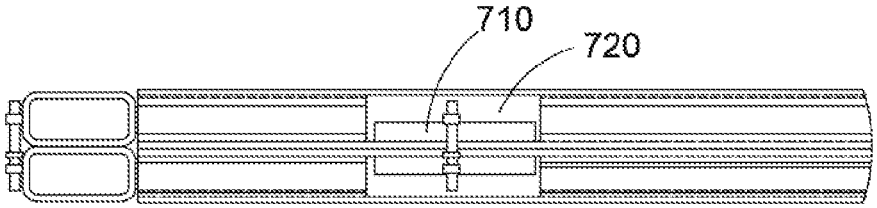
Figure 14B:
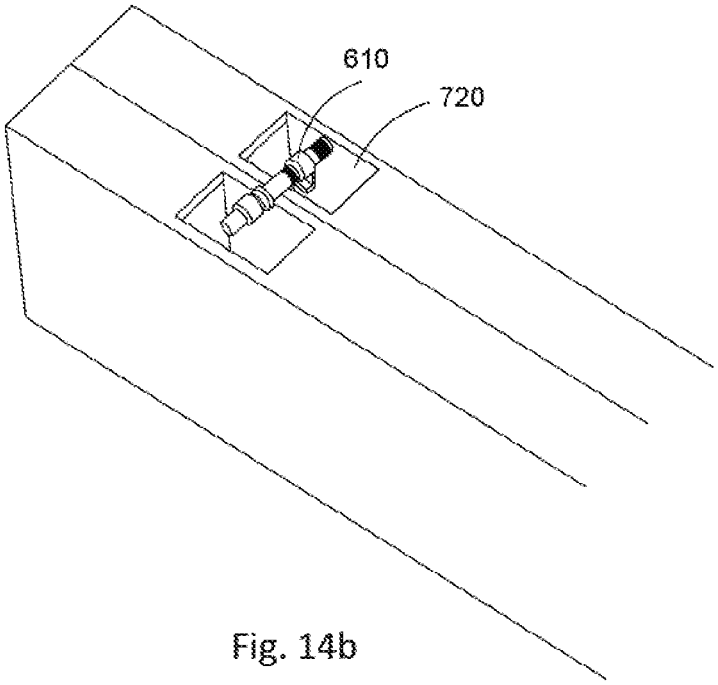

FIG. 7*a* is a cross-section view of an interface between two receptacles;

FIG. 7*b* is an enlarged view of an interface between two receptacles;

FIG. 8 is an isometric view of an embodiment of a swimming pool assembly;

FIG. 9*a* is a sketch of receptacles positioned above ground;

FIG. 9*b* is a sketch of receptacles positioned below ground with space allowing access for assembly;

FIG. 10 is an isometric view of an alternative arrangement of two receptacles;

FIG. 11 is an isometric view of the appropriate alignment of two receptacles in an alternative arrangement;

FIG. 12 is an exploded view of an alternative arrangement showing the appropriate interface frames and a sealing structure;

FIG. 13*a* is cutaway view of view of a swimming pool assembly according to embodiments of the claimed subject matter;

FIG. 13*b* is a cross sectional view of the edge of two joined receptacles according to embodiments of the claimed subject matter;

FIG. 14*a* is a cross sectional view of the edge of two joined receptacles according to embodiments of the claimed subject matter;

FIG. 14*b* is a perspective view of a clamp positioned in an access port for securing two joined receptacles together according to embodiments of the claimed subject matter;

FIG. 15*a* is a cross sectional view of the edge of two joined receptacles with a clamp according to embodiments of the claimed subject matter;

FIG. 15*b* is another view the edge of two joined receptacles with a clamp about to be fixed in position in an access port according to embodiments of the claimed subject matter; and FIG. 15*c* is a perspective view of a clamp according to embodiments of the claimed subject matter.

DETAILED DESCRIPTION OF THE EMBODIMENTS

The claimed subject matter provides pool structures and novel methods and systems of assembling the structure. In many of the embodiments, at least two intermodal shipping containers are modified and reinforced with appropriate framing so that they can be used as receptacles. Among other benefits, the framing used in the embodiments can configure several structures so that at least two receptacles can be secured together with a watertight interface between them.

Modification of a Metal Intermodal Shipping Container

Figure 1:
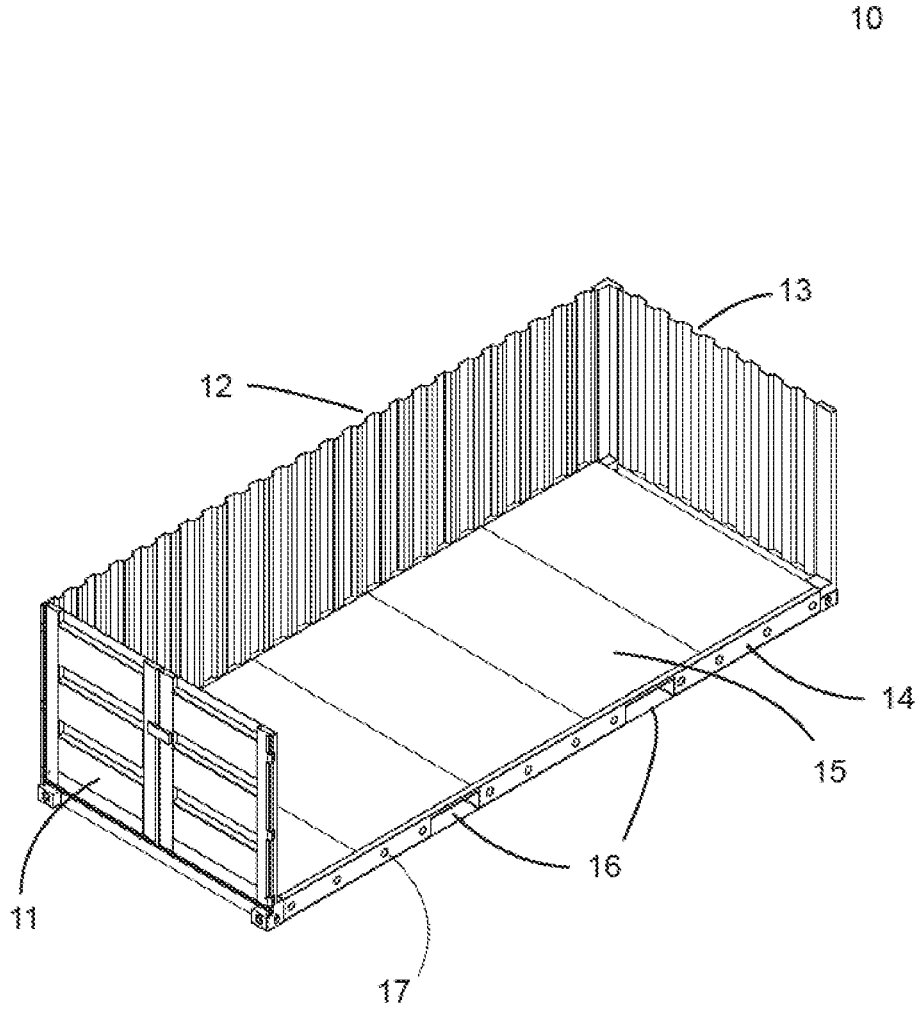

In one embodiment, each intermodal shipping container is modified to produce an open receptacle 10 shown in FIG. 1. A container begins as a rectangular, eight-corner, six-paneled, closed box (hollow rectangular prism) made of corrugated steel with double doors at one end (door end panel) opposite a small rectangular solid side (cap end panel) and completed with four long rectangular sides (bottom, top, front, and back panels). Portions of each container are removed, creating two matching receptacles. Each receptacle is an open box, comprising a door end panel 11, a cap end panel 13, two side panels (bottom panel 15, back panel 12), and a free edge. The free edge comprises a front edge 14, the front edges of the door end panel and the cap end panel, and the top edges of the door end panel, back panel, and cap end panel. Depending on the volume of the objective pool, the end panels and side panels may not be their original size. In FIG. 1, the front edge 14 has several guide holes 17 and fork-lift pockets 16. The guide holes are produced by machining or drilling techniques well known to the art.

Figure 2:
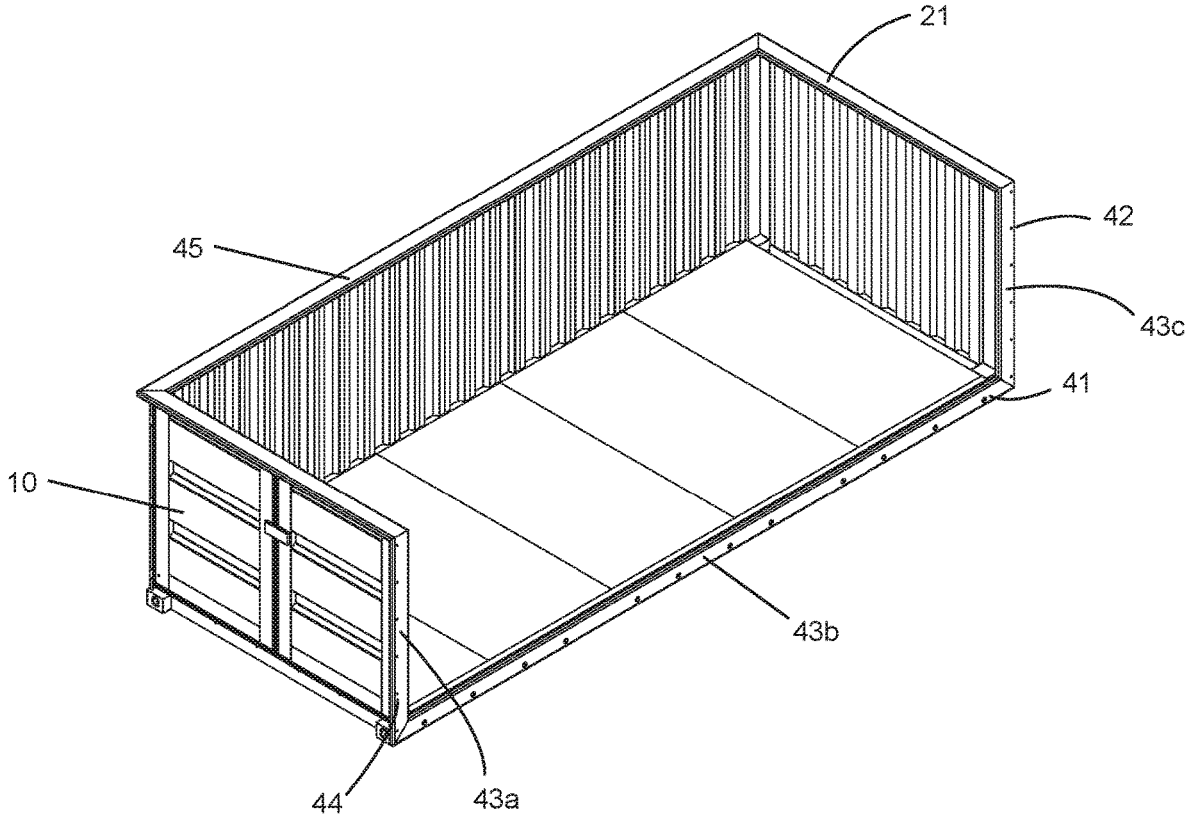

FIG. 2 shows further modification of a receptacle. A frame 21 is added to the free edge of a receptacle 10. The frame comprises at least a top interface portion 45 and a front interface portion 42 where the front interface portion is further comprised of two upright frame portions, 43*a* and 43*c*, and a bottom frame portion 43*b*. In one embodiment, bolt holes 44 are provided along the upright portions of the front interface portion. One or more of these bolt holes may be threaded to receive a bolt during assembly. Guide holes 41 are provided in the frame and align with guide holes 17 of FIG. 1.

Container to Container Interface

Figure 3A:
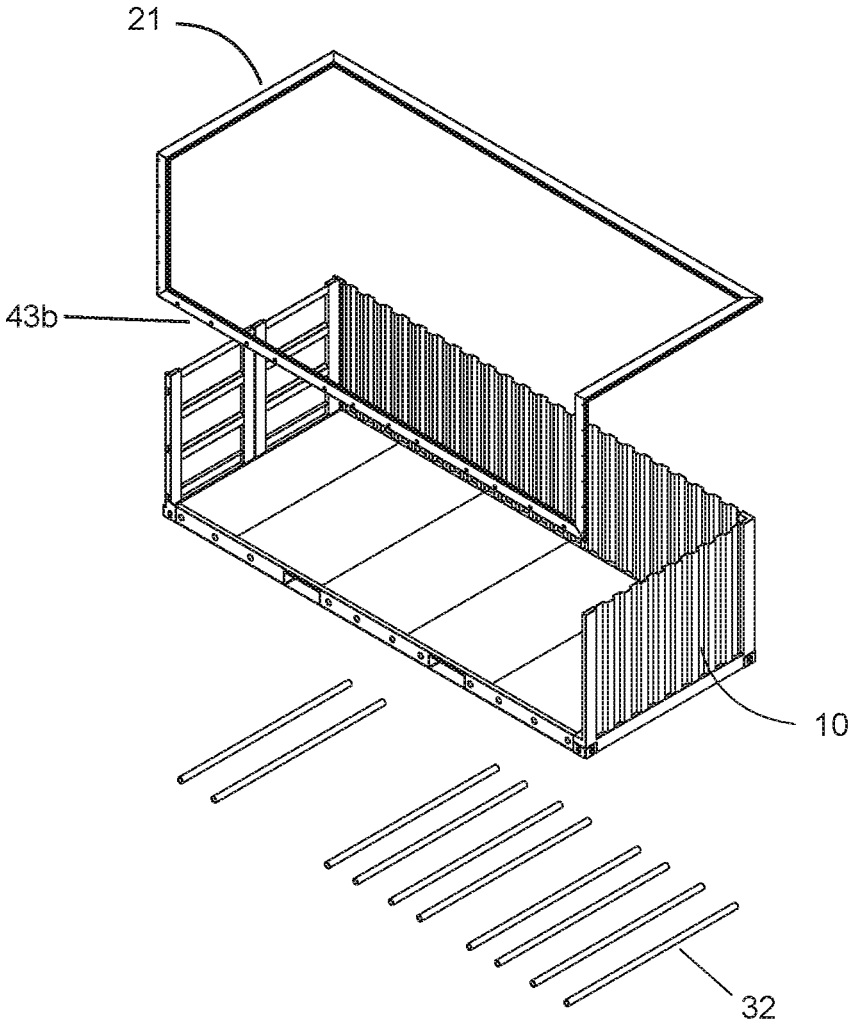
Figure 4:
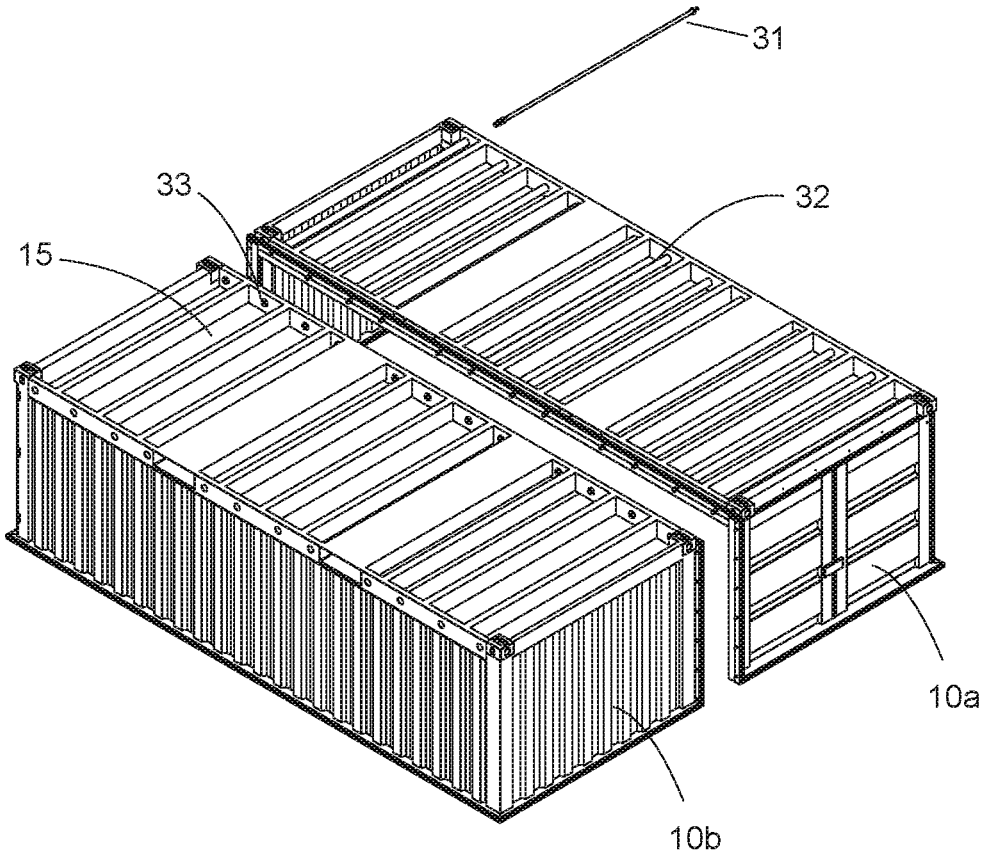
FIG. 4 is a bottom view of two receptacles showing relative locations of guide tubes, couplers, and a threaded rod prior to insertion in guide tube.

FIG. 3*a* shows an exploded view of a receptacle 10 and a frame 21. In one embodiment, the free edge of each open receptacle is reinforced with a metal rim feature welded to the edge (not shown). In many embodiments, this frame 21 is constructed from vertical portions of 4 inch×2 inch rectangular tubing and horizontal portions of 6 inch×2 inch rectangular tubing. Along at least a part of the bottom interface portion 43*b* guide tubes 32 are positioned beneath the bottom panel and attached orthogonal to the edge and extended to the back panel as shown in FIG. 4. When assembled, the guide tubes provide a continuous open bore from the receptacle's back panel through the bottom frame interface portion 43*b*.

Figure 3B:
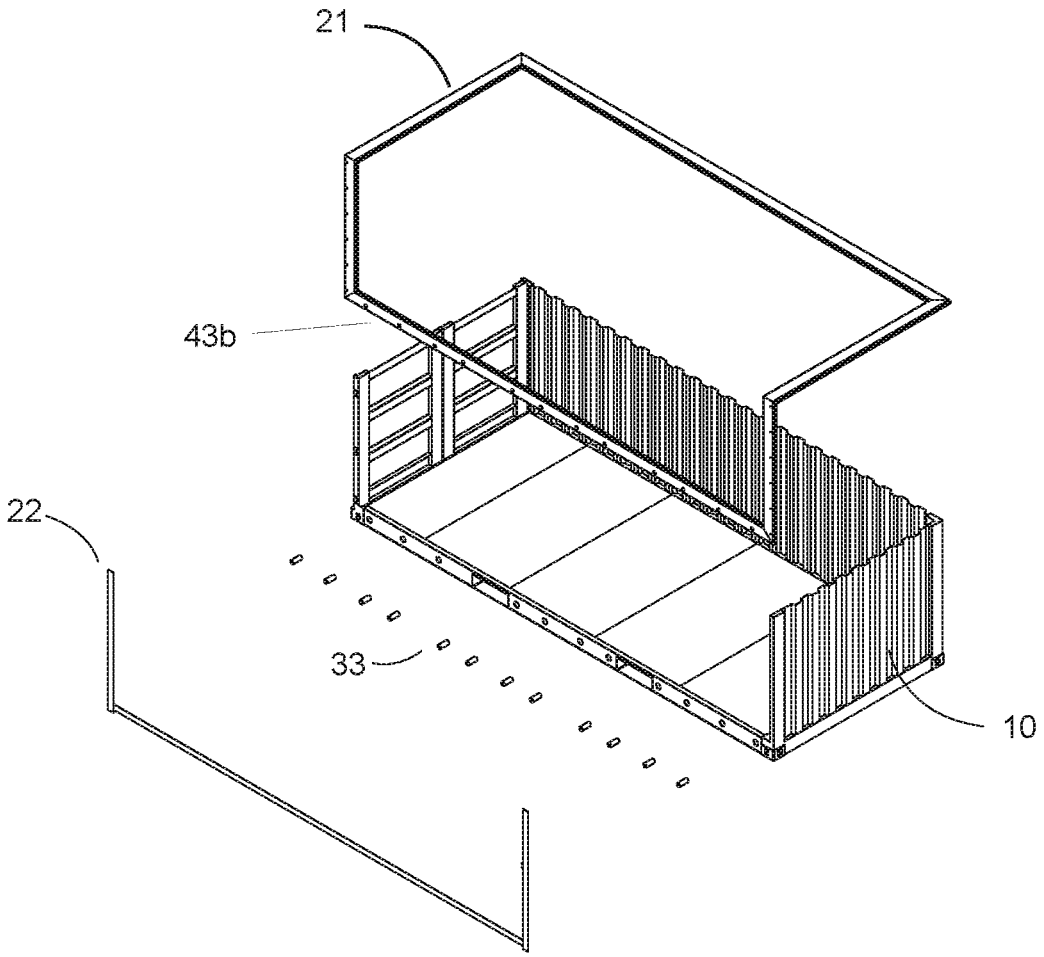

Along at least one interface frame portion of at least one receptacle threaded coupling features are fitted. In one embodiment, these threaded coupler features are similar to a captive nut appropriately scaled for a swimming pool assembly. The exploded view of a receptacle FIG. 3*b* shows threaded couplers 33. In many embodiments, these couplers are welded into positions and aligned with the guide holes and guide tubes as shown in FIG. 4. In another embodiment, the welded threaded couplers 33 are replaced with formed or cut threads in the bottom frame interface portion.

An elastomer structure 22 is shown in FIG. 3*b* to be positioned along the interface portion of frame 21. In many embodiments, the elastomer structure 22 helps produce a watertight seal along the interface between two receptacles. In these embodiments, the elastomer structure is glued or otherwise adhered to a receptacle's interface portion prior to joining receptacles. Additional adhesive may be added to provide improved sealing with the two joined receptacles.

In many embodiments, there is nothing required to be added to the faces where the section are mated together. In many of these embodiments, a waterproofing material can be positioned over the top of the seam and affixed to the assembly in the field. One or more methods can be used to waterproof the assembly seams including but not limited to: tile, welded stainless steel, spray sealant, polymer inserts, and polymer films.

FIG. 4 shows a bottom view of two receptacles prepared for assembly. In one embodiment, guide tubes 32 are positioned and fixed to one receptacle 10*a* and threaded couplers 33 are positioned and fixed on a mating receptacle 10*b*. A single threaded rod 31 is shown prior to insertion into a guide tube. In practice, a plurality of threaded rods 31 are used. Each guided tube 32 can receive and guide a threaded rod 31. In prior art assemblies and methods, access to the bottom of intermodal containers is required during assembly. However, it should be noted that threaded rod 31 can be inserted into the guide tubes without access to the bottom of the intermodal container receptacle 10. In many of the embodiments, the guide tubes 32 are not used as guide structures and guide structures are not always used.

In many embodiments, one or more other methods of joining two receptacles 10 may be used including, but not limited to, one or more plates used for compression of the receptacles 10 together, for instance with the use of one or more vices, clips or other joining devices to secure the sides of the intermodal container receptacles 10 together so that they are substantially positioned to be fixed in place relative to each other. Other embodiments may use magnets positioned in any suitable matter in order to be used to join two receptacles 10 together. In some of these embodiments, the one or more magnets may be positioned within one or more elements of the internodal container receptacles 10, for example the front edge 14, so that the one or more magnets may be added into one or more structural elements of each intermodal container receptacles 10 before the receptacles 10 are physically joined together. These types of joining elements (as well as other types of joining elements known to those skilled in the art) may be used alone or in conjunction with each other elements.

In many embodiments using guide tubes 32, the guide tubes 32 are constructed of metal or other material with sufficient durability to continue to act as a guide tube when a receptacle is placed in an excavated hole and backfilled. In these embodiments, the assembly of guide tubes 32 can be removed and disassembled and reassembled as needed at any time. In one embodiment, fork-lift pockets are used as guide structures. In many of the embodiments, any other structure that provides a guide channel for a threaded rod known to those skilled in the art may also be used.

In one embodiment, one receptacle 10*a* is fitted with guide tubes 32 and a mating receptacle 10*b* is fitted with threaded couplers 33. In other embodiments, a single receptacle 10 configuration can be used. In several of these embodiments, more than one receptacle 10 can be fitted with both threaded couplers and guide tubes in a pattern that allows two receptacles 10 to be aligned and clamped. In some of these embodiments, threaded couplers 33 (1) and guide tubes 32 (2) can be arranged in an alternating pattern, for example the pattern of (1)(2)(1)(2)(1)(2)(1)(2)(1)(2)(1)(2) used with each receptacle 10. When the receptacles 10 are aligned, the threaded couplers 33 will be opposite to the guide tubes 32 that are positioned on the adjacent receptacle 10.

Figure 5:
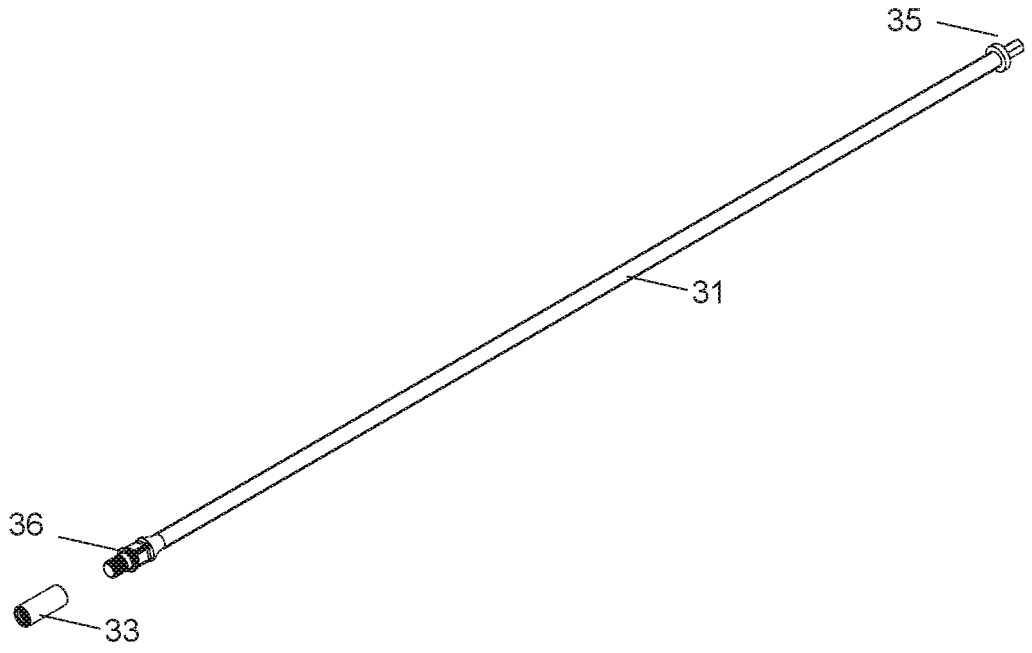
FIG. 5 is an isolated view of a threaded rod and a coupler.

An isolated view of a threaded rod 31 aligned with a threaded coupler 33 used with many embodiments is shown in FIG. 5. The threaded rod 31 has a threaded end 36 and a drive end 35. In some of these embodiments, the drive end 35 is machined or otherwise formed into a shape suitable to receive a drive tool (not shown). For example, some embodiments may use a hexagonal shape which can be used to receive a box wrench or socket, a shape known to those skilled in the art. Rotating the drive end 35 with a drive tool is intended to thread the threaded end 36 into the threaded coupler 33. In one embodiment, the length of the threaded rod 31 is sufficient to extend beyond the back panel of the receptacle and allow access to the drive end 35 while the threaded rod is inserted into a guide tube and the receptacle is resting on the ground. In one embodiment, a drive tool such as an extended length socket head could be used to drive a threaded rod whose drive end does not extend beyond the back panel.

Container Assembly and Principles of Construction

Figure 6:
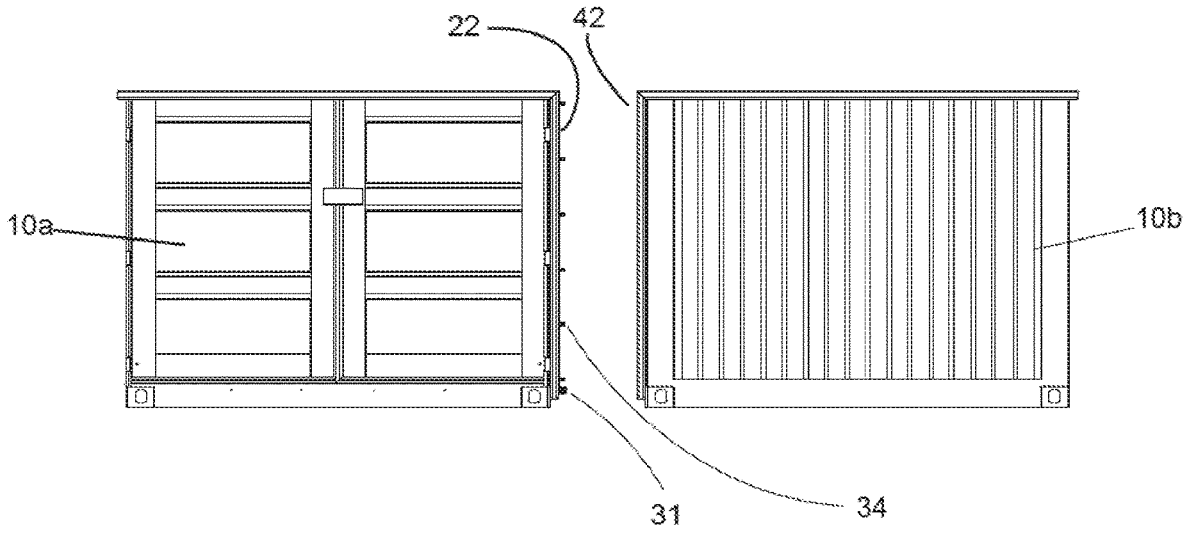
FIG. 6 is a view showing two receptacles suitably aligned for assembly.

In one embodiment, two receptacles 10, one prepared with guide tubes 32 and one prepared with threaded couplers 33, are positioned and assembled into a watertight swimming pool. Although several assembly steps are described here in a specific order, the assembly steps may be reordered according to the requirements of each project. The steps include:

1) Two intermodal container receptacles, receptacles 10*a* and 10*b*, are prepared as in FIG. 6. Prior to the assembly, both receptacles 10*a* and 10*b* remain transportable on standard roadways and, in these embodiments, do not constitute an oversized load.
2) A thin elastomer sealing material 22 is adhered to or otherwise held in place along the interface edge of at least one receptacle 10. In many of the embodiments, the thin elastomer sealing material 22 is optional.
3) The two receptacles 10*a* and 10*b* are positioned such that their frame interface portions 42 are facing one another.
4) The receptacles 10*a* and 10*b* are further positioned to align guide tubes 32 of 10*a* with threaded couplers 33 of 10*b*. Similarly, the bolt holes 44 as shown in FIG. 2 are aligned. FIG. 6 shows two receptacles 10*a* and 10*b* aligned but prior to reducing the gap between their respective interface portions.

5) The receptacles 10*a* and 10*b* are positioned such that the gap between the interface portions is less than the length of thread on threaded end 36 of a threaded rod 31 (as shown in FIG. 5). The position of receptacles 10*a* and 10*b* relative to each other shown in FIG. 6 is the assembly position.

6) In the assembly position, a threaded rod 31 of receptacle 10*b* is inserted into a guide tube 32 of receptacle 10*a*. Rotating the threaded rod 31 in a predetermined direction will drive the threaded end of the threaded rod 31 into the threaded coupler 33 of the receptacle 10*b*. Subsequent rotation of the threaded rod 31 in the predetermined direction acts to pull the receptacles together.

7) In one embodiment, a plurality of threaded rods 31 are inserted and suitably rotated to pull the receptacles 10*a* and 10*b* together. It is understood that the threaded rods 31 may need to be inserted and rotated in a particular order to successfully draw the receptacles together without disturbing the alignment of receptacles 10*a* and 10*b*. For example, if the threaded rod 31 in FIG. 4 is inserted and rotated, it will preferentially close the interface gap along the opposing upright frame portions of receptacles 10*a* and 10*b* and this could lead to the misalignment of the remaining guide tubes 32 and threaded couplers 33.

8) A plurality of bolts 34, whose threaded ends are shown protruding in FIG. 6, are inserted in bolt holes 44 (not shown in FIG. 6). The bolts 34 are secured by threading into the opposing threaded hole of receptacle 10*b* or inserting the bolts 34 through the through hole or receptacle 10*b* and using suitable washers and nuts to secure them.

9) Bolts 34 and threaded rods 31 are tightened such that the interface frames of receptacles 10*a* and 10*b* clamp the elastomer 22 substantially uniformly and with sufficient force to form a watertight seal.

10) FIGS. 7*a* and 7*b* show the cross-section of two receptacles 10*a* and 10*b* assembled. FIG. 7*b* is an enlarged view showing a threaded rod 31 fully inserted into a guide tube 32 and threaded fully into a threaded coupler 33. FIG. 8 shows an isometric view of two receptacles 10*a* and 10*b* assembled into assembly 20.

In these embodiments, the method of assembly is reversible such that the threaded rods 31 can be removed and the receptacles 10 repositioned. The disclosed assembly does not require welding along seam 24 or access to the interior space 90 during the assembly steps.

The modification of intermodal shipping containers and the method of assembly disclosed are appropriate for swimming pools located above ground in assembly 82 as shown in FIG. 9*a* or as a below ground assembly as shown in FIG. 9*b*. A gap or assembly space 81 is provided when placing the receptacles 10 are positioned below ground. This gap is shown along one receptacle 10 but it may have any other suitable shape or dimensions.

Some Alternative Configurations

In the embodiments, guide tubes 32 can be tubes, guide rings, a slot, more than one slots or a combination of these structures. They may also be anything known to those skilled in the art that would serve the same function of guiding the threaded rod 31 to the threaded coupler 33 and which may resist the threaded rod 31 from being deformed or filled with debris to an extent that causes the structure to no longer function as a guide for the threaded rod 31.

FIG. 4 shows the guide tubes 32 located on the exterior surface of the receptacle's bottom panel. In one embodiment, the guide tubes 32 can be fixed along the interior surface of the bottom panel. In these embodiments, the guide tubes 32 can be covered to provide a smooth interior pool surface.

One embodiment of the assembled receptacles 10 is the rectangle assembly 20 shown in FIG. 8. Other shapes may be used in other embodiment, for example the L shape 200 in FIG. 10 with any suitable shape or form being within the scope of this disclosure. The assembly in FIG. 10 has a seam 240, with an appropriate clamped seal structure 220 analogous to seam and seal structures 24 and 22, respectively, and which provides an inner space 900 for containing water. The receptacles 100*a* and 100*b* shown in FIG. 10 are intermodal containers modified according to the exploded view in FIG. 12. FIG. 12 shows the frame interface portions 430 of each frame 210*a* and 210*b*. As with the rectangular assembly 20 of FIG. 8, the L shape assembly is constructed by aligning each receptacle 100*a* and 100*b* such that their frame interface portions 430 are facing each other. An example of an alignment according to embodiments is shown in FIG. 11. In this embodiment, the receptacles 100*a* and 100*b* are positioned to align their respective guide holes 410 and bolt holes 440. Similar to the rectangular assembly 20 of FIG. 8, several guide tubes (not shown) are attached to the bottom of receptacle 100*a* and aligned with guide holes 410. Additionally, threaded couplers (not shown) are attached to the interface frame of receptacle 100*b*. Thus, when receptacles 100*a* and 100*b* are aligned and positioned appropriately far apart, a threaded rod 31 (not shown) can be inserted into a guide tube 32 and rotated in the guide tube 32 to thread into the threaded coupler 33 of the opposite receptacle. Rotating the threaded coupler 33 will pull the receptacles together and compress the frame interface portions 430 of each frame 210*a* and 210*b* so that the resulting assembly forms a watertight container. Other embodiments may frame join the interface portions 430 of each frame 210*a* and 210*b* with one or more other elements such as clips, vices, magnets and/or any other suitable joining element known to those skilled in the art so that the resulting assembly forms a substantially watertight container. In some embodiments, one or more gaps or less compressed areas between the frame interface portions 430 of each frame 210*a* and 210*b* may be utilized so that the water can flow in one or more directions, for example in a waterfall feature.

In one embodiment, two similarly modified receptacles 10*a* and 10*b* are joined to form a watertight container assembly 20 as shown in FIG. 8. However, more than two modified receptacles 10 can be prepared and joined to form a watertight container capable of containing a larger water volume. As previously described, the watertight container may also be designed to be non-watertight in one or more portions of the assembly 20. For example, the modified container assembly 10 as shown in in FIG. 1 can be further modified by removing back panel 12. In this embodiment, three container panels 13, 11 and 15 remain and can be joined with one or more other assemblies 10. In these embodiments, the modified, three-panel-container assembly 20 can be reinforced along the remaining free edges with a frame structure in a manner similar to the frame shown in FIG. 2 but with additional vertical and horizontal portions. The three-panel-container assembly can be sandwiched between the two container receptacles 10*a* and 10*b* as shown aligned in FIG. 6 with an additional seal structure. In these embodiments, the three-panel-container with more than one receptacle 10 can provide threaded couplers 33 suitably aligned to accept threaded rod from both modified containers shown in FIG. 6. Also in these embodiments, several three-panel-containers can be joined on site prior to the addition of the modified container receptacles 10*a* and 10*b* as shown in FIG. 6. In this way, embodiments may be constructed to any shape or dimension with a suitable volume of water.

In other embodiments, two similarly modified receptacles 10*a* and 10*b* are joined to form a watertight container assembly 20 as shown in FIG. 13*a*. As shown in FIGS. 13*b* and 13B, bolts 510 are inserted and placed through access ports on modified receptacles 10*a* and 10*b*. The bolts 510 are secured with nuts 520 so that the modified receptacles 10*a* and 10*b* are fixed together. In this embodiment, the 2"×4"× .2.5" steel tube vertical mating frame supports 540 are shown connected with ⅝-11" hardware bolt 510 within the steel tube vertical mating frame supports 540 positioned equally within the steel tube vertical mating frame supports 540 which are connected to one or more sides of each receptacle 10*a* and 10*b*. As shown in FIG. 13*b*, each of the ⅝-11" hardware bolt 510 is positioned through apertures in the sides of the tubing. Also shown in FIG. 13*b* are bolts 510 positioned through the 2"×6"×0.25" steel tube horizontal mating frame supports are connected with a plurality of 1" hardware bolts 510 through rectangular apertures cut into the tubing. The amount of 1" hardware bolts 510 which are used to secure the frame supports 540 can be varied according to the length of the frame supports 540 which will depend on the length of the sides of the receptacle 10.

Any other suitable fasteners in a suitable quantity may be used to secure two or more receptacles 10 together in a similar manner as described herein so that a watertight container assembly 20 is formed. The bolts 510 may be positioned through the walls of the modified receptacles 10*a* and 10*b* rather than the steel tube vertical mating frame supports or they may be positioned in any other suitable location so that the receptacles 10*a* and 10*b* can be fixed together.

In other embodiments, two similarly modified receptacles 10*a* and 10*b* are joined to form a watertight container assembly 20 as shown in FIGS. 14*a* and 15*b*. In FIGS. 14*a* and 14*b*, clamps 610 are shown both positioned through apertures cut into the frame supports and positioned through apertures cut into the walls of the modified receptacles 10*a* and 10*b*. One or more clamps 610 may be used as needed and the clamps may also be used instead of or in addition to the use of the bolts 510 as previously described. The clamps 610 may be any known clamps used with bolts and washer to secure two planar portions together. One or more clamps 610 may be used to support the attachment of one or more receptacles 10 to one or more other receptacles 10.

In other embodiments, two similarly modified receptacles 10*a* and 10*b* can be joined to form a watertight container assembly 20 as shown in FIGS. 15A and 15*b*. As shown in FIGS. 15*a* and 15*b*, a formed piece of clamp 710 is used to secure two sections of a receptacle 10 together in a fixed position. In these embodiments, the formed piece of clamp 710 can be driven into position with the use of a tool such as a hammer or any other device with a suitable amount of force needed to drive the clamp 710 into position. The clamp 710 may be constructed of steel or of any suitable material known to those skilled in the art. In many of the embodiments, access ports 720 are included in the structure of each of the receptables 10*a* and 10*b* so that access to the structures of each of the two receptables 10*a* and 10*b* can aid in allowing access so that the clamp 710 can be joined together.

In these embodiment, the clamp 710 is used with one or more access ports 720 to bring at least two of the wall sections of each of the receptables 10*a* and 10*b* closer as clamp 710 is driven further so that the two structure of each of the receptables 10*a* and 10*b* become secure and fastened tight against one another. In this way, this way of using the access ports 720 can lower the danger to the installers as they connect two portions of a container pool assembly 20 as the installer could be positioned inside the structure of assembly 20 rather than underneath the assembly 20. Once the connection of two structure of each of the receptables 10*a* and 10*b* is made, the access ports 720 can be covered and made to be watertight or waterproofed.

As described above, many of the embodiments do not require one or more guide structures. For example, some embodiments allow an installer to assemble the receptacles 10 from inside the pool. Other embodiments do not require a seal structure, for example a waterproofing membrane. In other embodiments, the middle waterproofing seam (or even an entire waterproofing membrane) can be constructed in field by the installer so it can be included with the embodiments. In other embodiments, the long couplers are replaced with bolts of one or more lengths.

It should be understood that the present inventive subject matter is not limited in its application to the details of construction and the arrangement of components set forth in the following description of the embodiments or the embodiments illustrated in the drawings. The inventive subject matter is capable of other embodiments and of being practiced or of being carried out in various ways. Also, it is to be understood that the terminology used herein is for the purpose of description and should not be regarded as limiting. The use of "includes", "including," "comprising," or "having" and variations is meant to encompass the items listed and their equivalents. Unless otherwise limited, the terms "attached", "connected," "coupled," "configured" and "mounted" and variations are used broadly and encompass direct and indirect connections, couplings and mountings. In addition, the terms "connected" and "coupled" and variations may include thermal, mechanical, and electrical connections. Furthermore, and as described in subsequent paragraphs, the specific mechanical configurations illustrated in the drawings are intended to exemplify embodiments of the claimed subject matter. However, other alternative mechanical and/or electrical and other configurations are possible which are considered to be within the teachings of the disclosure. It will be understood that the dimensions suggested in the description of the figures are for illustration only and are not limited to those presented in this disclosure.

The examples and embodiments that are described are intended to illustrate potential and specific implementations of the container assembly and methods for constructing the assembly. These examples are intended primarily for purposes of illustration. To those skilled in the art, it is clear that there may be variations to these examples without departing from the spirit of the disclosure. The intent is to claim the broadest allowable description of the disclosed innovation.

What is claimed is:

1. An assembly for holding water comprising:

a first receptacle comprising a first hollow rectangular prism having a first open top, a first bottom panel comprising one or more edges, at least three first side panels each comprising one or more edges, wherein the at least three first side panels are connected to the first bottom panel, and a first free edge comprising one or more of the edges of the first bottom panel and of the at least three first side panels, wherein the first free edge forms at least a top edge of the first receptacle and a front edge of the first receptacle;

a first frame having a first top frame interface portion rigidly attached to the top edge of the first receptacle and a first front frame interface portion rigidly attached to the front edge of the first receptacle;

a second receptacle comprising a second hollow rectangular prism having a second open top, a second bottom panel comprising one or more edges, at least three second side panels each comprising one or more edges, wherein the at least three second side panels are connected to the second bottom panel, and a second free edge comprising one or more of the edges of the second bottom panel and of the at least three second side panels, wherein the second free edge forms at least a top edge of the second receptacle and a front edge of the second receptacle;

a second frame having a second top frame interface portion rigidly attached to the top edge of the second receptacle and a second front frame interface portion rigidly attached to the front edge of the second receptacle; and one or more fasteners for securing the first frame and the second frame together when the first and second receptacles are suitably aligned;

wherein when the first and the second frames are secured together, the first receptacle and the second receptacle form an open top assembly configured to hold water.

2. The assembly of claim 1, further comprising a seal positioned between the first front frame interface portion of the first frame and the second front frame interface portion of the second frame.

3. The assembly of claim 2, wherein the seal comprises an elastomer gasket shaped to follow and conform to the first and second front interface portions of the first and the second frames, respectively.

4. The assembly of claim 2, wherein the seal comprises a compliant coating applied to at least one of: the first front frame interface portion of the first frame, and the second front frame interface portion of the second frame.

5. The assembly of claim 1, wherein the one or more fasteners comprise one or more bolts.

6. The assembly of claim 1, wherein the one or more fasteners comprise one or more clamps.

7. The assembly of claim 1, wherein the first receptacle and the second receptacle are configured such that the open top assembly is substantially L-shaped.

8. The assembly of claim 1, wherein the first receptacle is formed from an intermodal shipping container made of corrugated steel.

9. The assembly of claim 1, further comprising a guide structure configured to align the first receptacle and the second receptacle while securing the first frame and the second frame together with the one or more fasteners.

10. The assembly of claim 9, wherein the guide structure comprises one of more of: a channel, a pocket, and a tube.

11. The assembly of claim 1, wherein the second receptacle is formed from an intermodal shipping container made of corrugated steel.

* * * * *